US006435250B1

(12) United States Patent
Pichik et al.

(10) Patent No.: US 6,435,250 B1
(45) Date of Patent: Aug. 20, 2002

(54) RETRACTABLE DOORWAY GATE DEVICE

(76) Inventors: Marc D. Pichik; Christy F. Tvrdik, both of 26080 W. Blackhawk Ave., Ingleside, IL (US) 60041

( * ) Notice: Subject to any disclaimer, the term of this patent is extended or adjusted under 35 U.S.C. 154(b) by 0 days.

(21) Appl. No.: 09/797,654

(22) Filed: Mar. 5, 2001

(51) Int. Cl.[7] ..... A47H 1/00
(52) U.S. Cl. ..... 160/24; 160/903
(58) Field of Search ..... 160/24, 23.1, 290.1, 160/313, 315, 318, 323.1, 903, 98, 28, 370.22; 248/268, 267, 266

(56) References Cited

U.S. PATENT DOCUMENTS

| | | | | | |
|---|---|---|---|---|---|
| 746,403 | A | * | 12/1903 | Tarney | 160/23.1 |
| 1,216,794 | A | * | 2/1917 | Garman | 160/23.1 |
| 2,015,993 | A | * | 10/1935 | Drake | 160/23.1 |
| 4,492,263 | A | | 1/1985 | Gebhard | |
| 4,787,174 | A | | 11/1988 | Brown | |
| 4,852,194 | A | | 8/1989 | Langan | |
| D341,207 | S | | 11/1993 | Freese et al. | |
| 5,505,244 | A | * | 4/1996 | Thumann | 160/23.1 |
| 5,531,258 | A | | 7/1996 | Poulson et al. | |
| 5,636,679 | A | * | 6/1997 | Miller et al. | 160/290.1 X |
| 5,638,885 | A | | 6/1997 | Freese et al. | |
| 5,657,809 | A | | 8/1997 | Longoria et al. | |
| 5,660,144 | A | | 8/1997 | Venti | |
| 5,702,143 | A | * | 12/1997 | Shimazaki | 160/24 X |
| 6,089,302 | A | * | 7/2000 | Britt | 160/98 |

* cited by examiner

*Primary Examiner*—David M. Purol

(57) ABSTRACT

A retractable doorway gate device for providing a safety gate preventing pets and kids from gaining access to unsafe areas in and about a building structure. The retractable doorway gate device includes a bracket assembly including a plurality of bracket members being adapted to be attached in a doorway; and also includes a gate support assembly being mounted to the bracket assembly; and further includes a gate member being carried by the gate support assembly and being adapted to extend across the doorway with the gate member being a mesh screen.

6 Claims, 2 Drawing Sheets

RETRACTABLE DOORWAY GATE DEVICE

BACKGROUND OF THE INVENTION

1. Field of the Invention

The present invention relates to a retractable pet and kid gate and more particularly pertains to a new retractable doorway gate device for providing a safety gate preventing pets and kids from gaining access to unsafe areas of in an around a building structure.

2. Description of the Prior Art

The use of a retractable pet and kid gate is known in the prior art. More specifically, a retractable pet and kid gate heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,638,885; U.S. Pat. No. 5,660,144; U.S. Pat. No. 5,531,258; U.S. Pat. No. 4,787,174; U.S. Pat. No. 4,852,194; U.S. Pat. No. 4,492,263; U.S. Pat. No. 5,657,809 and U.S. Pat. No. Des. 341,207.

While these devices fulfill their respective, particular objectives and requirements, the aforementioned patents do not disclose a new retractable doorway gate device. The inventive device includes a bracket assembly including a plurality of bracket members being adapted to be attached in a doorway; and also includes a gate support assembly being mounted to the bracket assembly; and further includes a gate member being carried by the gate support assembly and being adapted to extend across the doorway with the gate member being a mesh screen.

In these respects, the retractable doorway gate device according to the present invention substantially departs from the conventional concepts and designs of the prior art, and in so doing provides an apparatus primarily developed for the purpose of providing a safety gate preventing pets and kids from gaining access to unsafe areas in and about a building structure.

SUMMARY OF THE INVENTION

In view of the foregoing disadvantages inherent in the known types of retractable pet and kid gate now present in the prior art, the present invention provides a new retractable doorway gate device construction wherein the same can be utilized for providing a safety gate preventing pets and kids from gaining access to unsafe areas in and about a building structure.

The general purpose of the present invention, which will be described subsequently in greater detail, is to provide a new retractable doorway gate device which has many of the advantages of the retractable pet and kid gate mentioned heretofore and many novel features that result in a new retractable doorway gate device which is not anticipated, rendered obvious, suggested, or even implied by any of the prior art retractable pet and kid gate, either alone or in any combination thereof.

To attain this, the present invention generally comprises a bracket assembly including a plurality of bracket members being adapted to be attached in a doorway; and also includes a gate support assembly being mounted to the bracket assembly; and further includes a gate member being carried by the gate support assembly and being adapted to extend across the doorway with the gate member being a mesh screen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable doorway gate device which has many of the advantages of the retractable pet and kid gate mentioned heretofore and many novel features that result in a new retractable doorway gate device which is not anticipated, rendered obvious, suggested, or even implied by any of the prior art retractable pet and kid gate, either alone or in any combination thereof.

It is another object of the present invention to provide a new retractable doorway gate device which may be easily and efficiently manufactured and marketed.

It is a further object of the present invention to provide a new retractable doorway gate device which is of a durable and reliable construction.

An even further object of the present invention is to provide a new retractable doorway gate device which is susceptible of a low cost of manufacture with regard to both materials and labor, and which accordingly is then susceptible of low prices of sale to the consuming public, thereby making such retractable doorway gate device economically available to the buying public.

Still yet another object of the present invention is to provide a new retractable doorway gate device which provides in the apparatuses and methods of the prior art some of the advantages thereof, while simultaneously overcoming some of the disadvantages normally associated therewith.

Still another object of the present invention is to provide a new retractable doorway gate device for providing a safety gate preventing pets and kids from gaining access to unsafe areas in and about a building structure.

Yet another object of the present invention is to provide a new retractable doorway gate device which includes a bracket assembly including a plurality of bracket members being adapted to be attached in a doorway; and also includes a gate support assembly being mounted to the bracket assembly; and further includes a gate member being carried by the gate support assembly and being adapted to extend across the doorway with the gate member being a mesh screen.

Still yet another object of the present invention is to provide a new retractable doorway gate device that is easy and convenient to set up in any doorway of a building structure.

Even still another object of the present invention is to provide a new retractable doorway gate device that prevents pets and small kids from wandering about the house while the parents are asleep.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
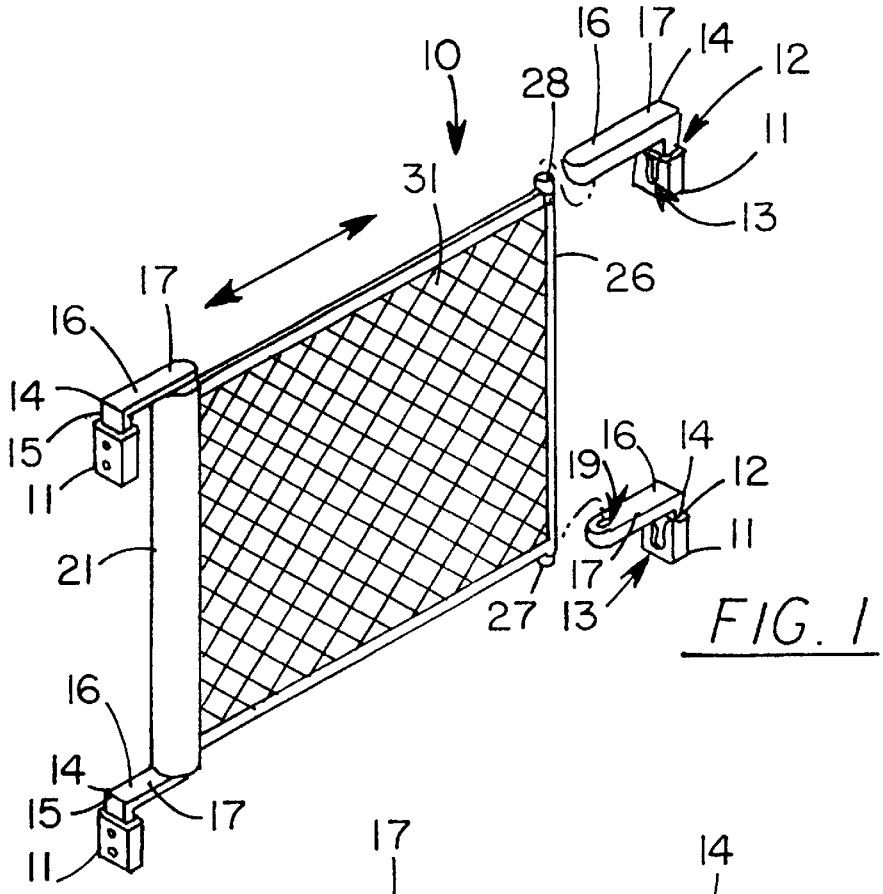
FIG. 1 is a perspective view of a new retractable doorway gate device according to the present invention.
Figure 2:
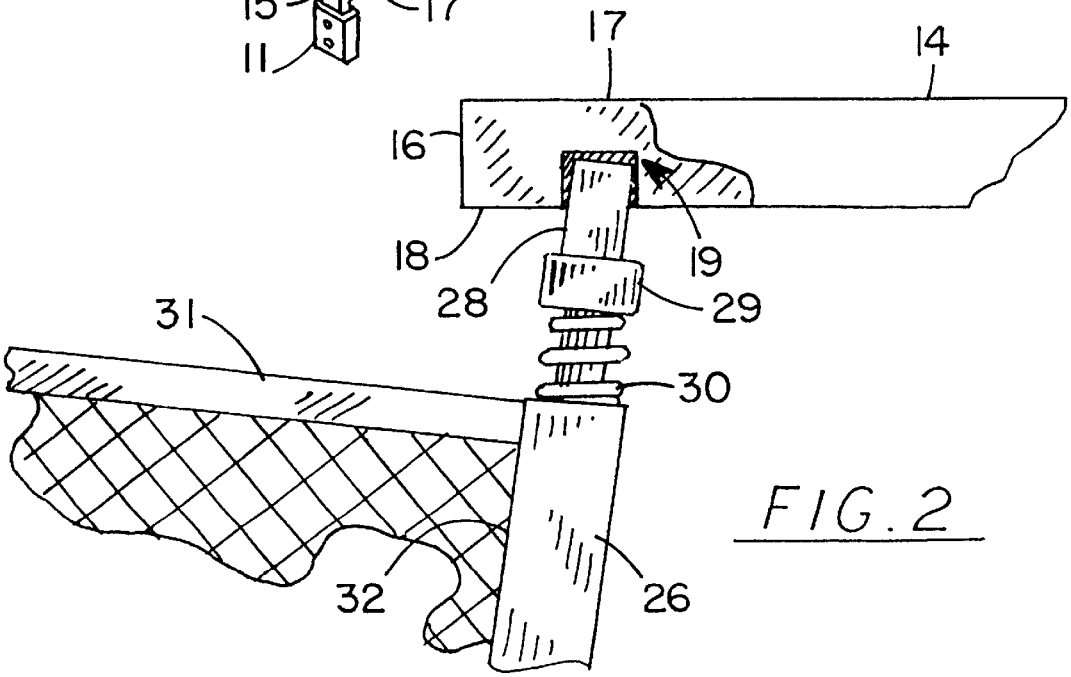
FIG. 2 is a detailed partial front elevational view of the present invention.
Figure 3:
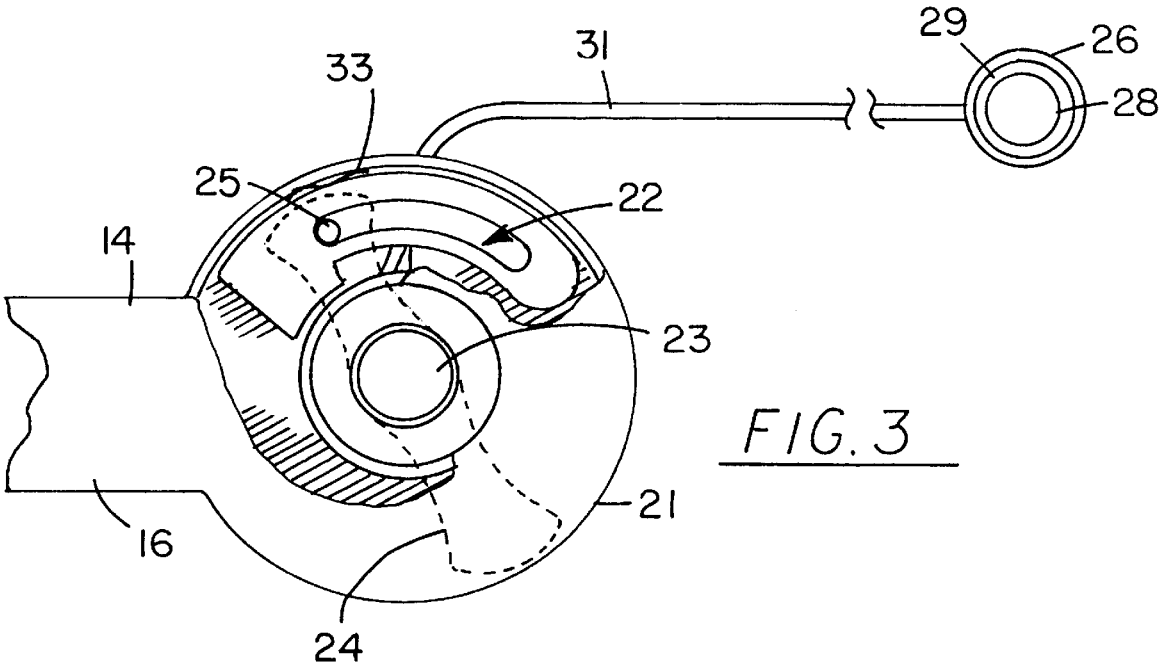
FIG. 3 is a detailed partial top plan view of the present invention.
Figure 4:
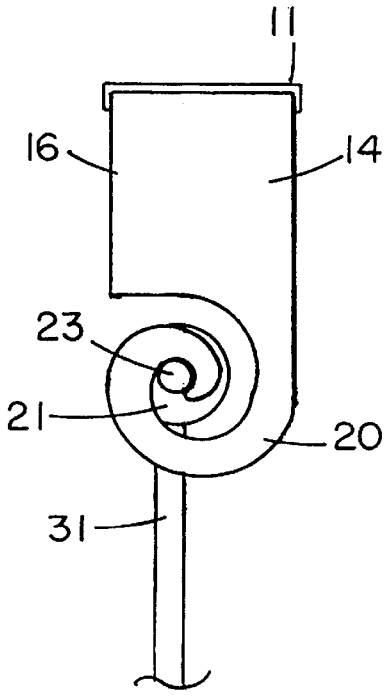
FIG. 4 is a detailed partial top plan view of a second embodiment of the present invention.

With reference now to the drawings, and in particular to FIGS. 1 through 4 thereof, a new retractable doorway gate device embodying the principles and concepts of the present invention and generally designated by the reference numeral 10 will be described.

As best illustrated in FIGS. 1 through 4, the retractable doorway gate device 10 generally comprises a bracket assembly including a plurality of bracket members 11 being adapted to be conventionally attached in a doorway. The bracket assembly further includes a plurality of arm members 14 being removably and conventionally mounted to the bracket members 11. Each of the arm members 14 has an elongate main portion 16 and an end portion 15 which is angled relative to the elongate main portion 16 and which is removably mounted to a respective bracket member 11. The bracket members 11 include upper bracket members and lower bracket members. Each of the bracket members 11 is a block-like member having a bore 12 being disposed therein through a top thereof and also having a slot 13 being disposed through a front thereof and into the bore 12. The end portion 15 of each of the arm members 14 is removably disposed in the bore 12 of a respective bracket member 11. The arm members 14 include upper arm members and lower arm members.

A gate support assembly is conventionally mounted to the bracket assembly. The gate support assembly includes an elongate housing 21 having a curved slot 22 in an end thereof, and also includes a spool 23 being rotatably disposed in the elongate housing 21 and having ends which are mounted to the main portions 14 of a pair of the arm members 14, and further includes a clutch member 24 being pivotally and conventionally mounted to the spool 23, and also includes a stop member 25 being conventionally attached to the clutch member 24 and being disposed through the curved slot 22, and further includes a spring 33 being conventionally disposed in the elongate housing 21 and being in contactable relationship with the clutch member 24 for braking the clutch member 24. The gate support assembly further includes a tubular member 26, and also includes a first shaft member 27 conventionally extending from one end of the tubular member 26 and being removably and conventionally mounted to one of the arm members 14, and further includes a second shaft member 28 being retractably mounted at another end of the tubular member 26 and being removably and conventionally mounted to another one of the arm members 14, and also includes an annular flange 29 being conventionally disposed about the second shaft member 28, and further includes a spring member 30 being conventioinally disposed about the second shaft member 28 and being disposed between the tubular member 26 and the annular flange 29 for biasing the second shaft member 28 outwardly. A gate member 31 is conventionally carried by the gate support assembly and is adapted to extend across the doorway. The gate member 31 includes screen support members and also includes a mesh screen having a height of approximately 36 inches with the mesh screen being conventionally attached to the screen support members and being carried about the spool 23 and having an outer side edge 32 which securely and conventionally attached to the tubular member 26. The clutch member 24 keeps the screen support member tight so that the gate member 31 cannot be broken down.

As a first embodiment, each of the upper arm members 14 has a slot 19 being disposed in a bottom 18 and near an end of a respective elongate main portion 16, and each of the lower arm members 14 has a slot 19 being disposed in a top 17 and near an end of a respective elongate main portion 16. As a second embodiment, each of the main portions 16 has an end 20 which is coiled.

In use, the user securely fastens the bracket members 11 to the door jamb of a doorway and mounts the arm members 14 to the bracket members 11, and also mounts the elongate housing and spool 23 to an upper and lower arm members 14, and releases the mesh screen 31 from about the spool 23 and extends the mesh screen 31 across the doorway and connects the first and second shaft members 27,28 to the respective upper and lower arm members 14 to secure the mesh screen 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A retractable gate device for impeding movement between first and second spaced supports, said gate device comprising:

a bracket assembly including a plurality of bracket members, at least a first one of said bracket members being adapted for attaching to the first spaced support and at least a second one of said bracket members being adapted for attaching to the second spaced support;

a gate support assembly being mounted to the first one of said bracket members of said bracket assembly; and a gate member being carried by said gate support assembly and being adapted to extend between the spaced supports, said gate member including screen support members and a screen being attached to said screen support members, said gate member having a free end being movable away from said gate support assembly when said gate member is extended and being movable toward said gate support assembly when said gate member is retracted;

releasable mounting means for removably mounting said free end of said gate member to the second one of said bracket members of said bracket assembly;

wherein said releasable mounting means comprises a protrusion extending from said free end of said gate member, and a coiled member formed on the second one of said bracket members and defining a coiled slot for receiving and trapping a portion of said protrusion on said free end for releasably securing said free end of said gate member to the second one of said bracket members.

2. A retractable gate device for impeding movement between first and second spaced supports, said gate device comprising:

a bracket assembly including a plurality of bracket members, at least a first one of said bracket members being adapted for attaching to the first spaced support and at least a second one of said bracket members being adapted for attaching to the second spaced support;

a gate support assembly being mounted to the first one of said bracket members of said bracket assembly; and a gate member being carried by said gate support assembly and being adapted to extend between the spaced supports, said gate member including screen support members and a screen being attached to said screen support members, said gate member having a free end being movable away from said gate support assembly when said gate member is extended and being movable toward said gate support assembly when said gate member is retracted;

releasable mounting means for removably mounting said free end of said gate member to the second one of said bracket members of said bracket assembly;

wherein said releasable mounting means comprising a depressible protrusion formed on at least one of upper and lower ends of said free end of said gate member, and a cavity formed in the second one of said bracket members for receiving said depressible protrusion.

3. A retractable gate device as described in claim 2, wherein said bracket assembly further includes a plurality of arm members being removably mounted to said bracket members, each of said arm members having an elongate main portion and an end portion which is removably mounted to a respective said bracket member.

4. A retractable gate device as described in claim 3, wherein each of said bracket members has a bore being disposed therein through a top thereof for removably receiving a portion of one of said arm members.

5. A retractable gate device as described in claim 2, wherein said releasable mounting means comprises:

a tubular member at said free end of said gate member;

a first shaft member extending from one end of said tubular member;

a second shaft member being retractably mounted at another end of said tubular member;

an annular flange being disposed about said second shaft member;

a spring member being disposed about said second shaft member and being disposed between said tubular member and said annular flange for biasing said second shaft member outwardly.

6. A retractable gate device for impeding movement between first and second spaced supports, said gate device comprising:

a bracket assembly including a plurality of bracket members at least a first one of said bracket members being adapted for attaching to the first spaced support and at least a second one of said bracket members being adapted for attaching to the second spaced support;

a gate support assembly being mounted to the first one of said bracket members of said bracket assembly; and a gate member being carried by said gate support assembly and being adapted to extend between the spaced supports, said gate member including screen support members and a screen being attached to said screen support members, said gate member having a free end being movable away from said gate support assembly when said gate member is extended and being movable toward said gate support assembly when said gate member is retracted;

releasable mounting means for removably mounting said free end of said gate member to the second one of said bracket members of said bracket assembly;

wherein said gate support assembly includes a clutch means for keeping said screen support members tight so that said mesh screen cannot be broken down when said gate member is extended;

wherein said gate support assembly comprises:

an elongate housing having a curved slot in an end thereof;

a spool being rotatably disposed in said elongate housing and having ends which are mounted to the first one of said bracket members;

wherein said clutch means comprises:

a clutch member being pivotally mounted to said spool;

a stop member being attached to said clutch member and being disposed through said curved slot; and a spring being disposed in said elongate housing and being in contactable relationship with said clutch member for braking said clutch member.

* * * * *